United States Patent [19]

Schulz

[11] 4,184,439

[45] Jan. 22, 1980

[54] DEVICE FOR FOLDING A STRIP OF MATERIAL

[76] Inventor: Rudi Schulz, Kaiserslautern, Fed. Rep. of Germany

[73] Assignee: Pfaff Industriemaschinen GmbH, Fed. Rep. of Germany

[21] Appl. No.: 943,354

[22] Filed: Sep. 18, 1978

[30] Foreign Application Priority Data

Oct. 18, 1977 [DE] Fed. Rep. of Germany ... 7732141[U]

[51] Int. Cl.[2] ..... D05B 35/06

[52] U.S. Cl. ..... 112/147; 112/152

[58] Field of Search ..... 112/147, 141, 142, 143, 112/152, 136, 121.27; 223/30, 34

[56] References Cited

U.S. PATENT DOCUMENTS

| | | | |
|---|---|---|---|
| 1,357,105 | 10/1920 | McCoy | 112/147 |
| 1,724,274 | 8/1929 | Gatchell | 112/147 X |
| 1,959,121 | 5/1934 | Allen | 112/147 |
| 2,096,691 | 10/1937 | Ackerman et al. | 112/147 |
| 4,120,252 | 10/1978 | Glassman | 112/143 |

*Primary Examiner*—H. Hampton Hunter
*Attorney, Agent or Firm*—McGlew and Tuttle

[57] ABSTRACT

A device for folding a strip of material, comprises, a support with a substantially U-shape guide having divergent first and second guide legs mounted on said support and having a widened entrance end for the insertion of a strip of material and a narrow discharge end for the discharge of the material. The guide is of a tapered, funnel-shape form, tapering inwardly from the entrance end to the discharge end and it is arranged alongside of a substantially U-shape folding element which is engageable therewith. The folding element is pivotally mounted on the support adjacent the guide and it includes a central folding web portion engageable into the guide between the guide legs and a leg portion joined to each side of the central web portion adapted to engage over the guide legs to fold the material thereover. The device is usable in association with a sewing machine in which, after the material is folded, it is engaged with a garment and sewn along the edge thereof.

6 Claims, 3 Drawing Figures

DEVICE FOR FOLDING A STRIP OF MATERIAL

FIELD AND BACKGROUND OF THE INVENTION

This invention relates in general to the construction of devices for folding strip materials, particularly for use in association with sewing machines and, in particular, to a new and useful material folding device which comprises a substantially U-shape guide which tapers from a widened entrance end to a narrowed discharge end, wherein, a material strip is insertable in the guide and held by a positioning plate as it is moved therealong to fold it into a U-shape configuration and which further includes a folding element of substantially W-shape configuration with a central folding web which engages into the guide to hold the material therein and includes leg portions which engage over the guide.

DESCRIPTION OF THE PRIOR ART

When sewing a strip of material to a garment, such as a waistband, to a pair of trousers or to a ladies skirt, the strip of material is fed through a sheet metal guide which tapers down in a funnel shape towards the stitch-forming point. This causes the two lateral edges to be folded over inwardly and the strip of material to be folded into an approximately horizontally oriented U-shape configuration. Before insertion of the upper garment edge, the starting area of the strip of material must be turned in towards the inside to obtain an exact edge terminus. This turning-in is performed manually by the seamstress and requires not only some skill and attention in the execution, but is also time-consuming. It is almost impossible to obtain the turn-in in an exact form without a tool, such as a pair of scissors.

SUMMARY OF THE INVENTION

The present invention is an improvement over the prior art in the provision of a device for handling a strip of material which is to be turned in or folded. In accordance with the invention, a strip of material is folded by means of an open sheet metal guide which tapers downwardly in a funnel formed toward the stitch-forming point of a sewing machine. In addition, there is provided, a holding element which may be pivoted to engage a central folding web portion into the guide element between the folded parts of the material to turn in the material strip start.

Accordingly, it is an object of the invention to provide a device for folding a strip of material which comprises a substantially U-shape guide mounted on a support which has divergent first and second leg portions and a widened entrance end which tapers down to a narrow discharge end for the strip material which is arranged alongside of a substantially W-shaped folding element which is engageable therewith and has a central folding web portion engageable into the guide between the guide legs and a folding leg portion joined to each side of the central web portion adapted to engage over the guide legs and which is mounted for pivotal movement into and out of the guide.

A further object of the invention is to provide a device for folding strip material which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
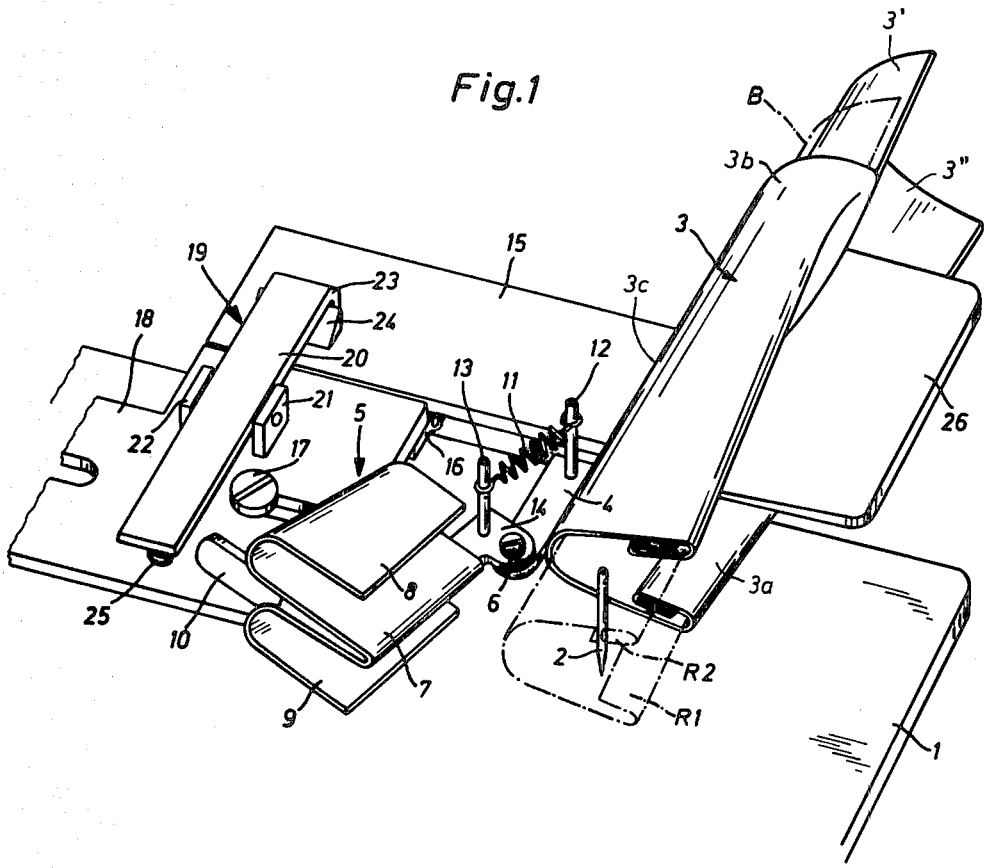
FIG. 1 is a top perspective and partly schematic showing of a material feeding device for a sewing machine, constructed in accordance with the invention.

Referring to the drawing in particular, the invention embodied therein, comprises, a device for folding a strip material and for feeding it into association with a reciprocating needle 2 of a sewing machine so that the material which is folded may be joined to a garment or similar other material part. In accordance with the invention, a substantially U-shaped guide, generally designated 3, which has divergent first and second guide legs 3' and 3'' is mounted on a support, such as a fabric support plate 1, and it has a widened entrance end **3*b* for the insertion of a strip of material B and a narrow discharge end 3*a*** for the discharge of the material and which is of tapered funnel-shaped form tapering inwardly from the widened entrance end to the narrow discharge end.

Figure 2:
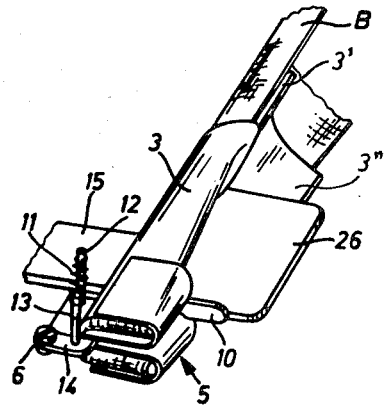
FIG. 2 is a perspective view of the device shown in FIG. 1 in a somewhat reduced scale showing the engagement of the folding element with the material guide to fold the material.

In accordance with a feature of the invention, a substantially W-shaped folding element, generally designated 5, is engageable with the guide 3 and has a central folding web portion 7 which is engageable into the guide between the guide legs 3' and 3'' and a leg portion 8 and 9 joined to respective sides of said central web portion 7 and adapted to engage over the guide legs in an operating position as shown in FIG. 2. Mounting means in the form of a threaded screw 6 engageable with a web 4 mounted over the support plate 1 provides mounting of the folding element 5 for pivotal movement adjacent the discharge end of the guide 3.

FIG. 1 is a partial view of the fabric support plate of a sewing machine, which includes a needle 2. Since the application of the new device is not limited to a specific type of sewing machine, the sewing machine has not been shown in great detail. The device to fold a strip of material comprises a sheet metal guide 3 which tapers inwardly in funnel-shape form towards a first end **3*a* adjacent the needle 2 and is open unilaterally at the opposite trailing material strip end 3*b*. When passing the material strip B through the sheet metal guide 3, its two lateral edges are simply folded over inwardly as shown at $R_1$ and $R_2$, and are then folded into an approximately horizontally oriented U-shape, as shown by the dash-dotted lines in FIG. 1**.

A web 4 is provided on the closed side **3*c* of sheet metal guide 3, to which a folding element 5 is mounted so as to be pivotable about a threaded pin 6. Folding element 5 has a central folding web portion 7, adjoined by two guide legs 8 and 9, and a handle 10 is provided on the outside. The folding element 5 is acted upon by an extension spring 11, one end of which is anchored to a pin 12, fastened in the web 4, and its other end is anchored to a pin 13 fastened to a lug 14 of the folding element 5**.

The sheet metal guide 3 with the folding element 5 is mounted to a support plate 15 which is hinged by a hinge 16 to a baseplate 18 screwed by screws 17 to the fabric support plate 1. It is also possible to link the support plate 15 directly to the fabric support plate 1 of a sewing machine.

To lock the support plate 15 with the sheet metal guide 3 and the folding element 5 in working positions, a detent 19 is provided which comprises a dual-armed lever 20 pivoting in bearing blocks 21 and 22 of the baseplate 18 and having a bent end 23 which grips behind a protrusion 24 provided on the support plate 15 in the working position of the device. A compression spring 25 acts upon the other end of the lever 20. In order to facilitate the positioning and feeding of the garment W, the open side of sheet metal guide 3 is provided with a positioning plate 26.

The operating mode of the device is as follows: Before sewing the strip of material B to the upper edge of the garment W, the strip of material B is pushed through the sheet metal guide 3, thereby, folding its two edges $R_1$ and $R_2$ over once inwardly and imparting a horizontally oriented U-shape configuration to the strip of material B. In order to make room for the movement of the folding element 5 for the subsequent turning-in of the start of the strip of material, the lock between the support plate 15 and the baseplate 18 is released by pivoting the lever 20 against the force of the compression spring 25, whereupon, the support plate 15 with the sheet metal guide 3 and the folding element 5 is pivoted downwardly about the pivot pin of hinge 16 so that the trailing end of the sheet metal guide 3 is oriented upwardly.

The strip of material B is then pushed through the sheet metal guide 3 as far as is required to turn in the start of the strip of material. The folding element 5 is then pivoted by hand about the threaded pin 6 from its position at rest into the folding position, as shown in FIG. 2. In so doing, the folding web 7 pushes the folded start of the strip of material from the closed side inwardly between the legs of the strip of material B folded into a horizontally oriented U-shape configuration into the position according to FIGS. 2 and 3.

This turning-in of the start of the strip of material B is supported by the extension spring 11 which is moved past its fully stretched position while pivoting from the one position into the other.

Figure 3:
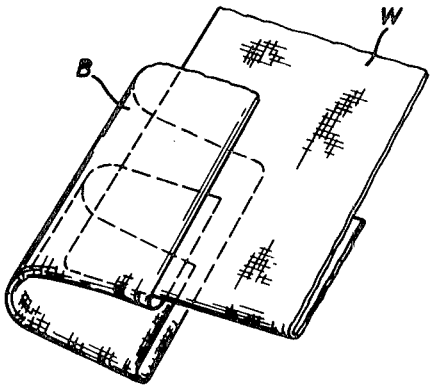
FIG. 3 is a perspective view showing the interengagement of a garment and a folded material before they are sewn together.

After turning in the start of the strip material B, the folding element 5 is moved back into its starting position in which it is held by the extension spring 11. The support plate 15 with the sheet metal guide 3 and the folding element 5 is then pivoted about the pivot pin of hinge 16 into the working position shown in FIG. 1, and is locked by the end 23 of lever 20 snapping behind the protrusion 24. As shown in FIG. 3, the upper edge of the garment W is then inserted so as to abut the inside edge of the material strip start, whereupon, the strip of material B is sewn to the upper edge of the garment W.

Turning-in of the start of the material strip can be accomplished quickly and simply with the above-disclosed device. The achievable quality of the edge terminus on a garment is largely independent of the dexterity of the seamstress when the device according to the invention is used.

While a specific embodiment of the invention has been shown and described in detail to illustrate the application of the principles of the invention, it will be understood that the invention may be embodied otherwise without departing from such principles.

What is claimed is:

1. A device for folding a strip of material, comprising, a support, a substantially U-shape guide having divergent first and second guide legs and mounted on said support and having a widened entrance end for the insertion of the strip of material and a narrow discharge end for the discharge of the material, and being of a tapered funnel form, tapering inwardly from said widened entrance end to said discharge end, a substantially W-shape folding element engageable with said U-shape guide and having a central folding web portion engageable into said guide between said guide legs and a folding leg portion joined to each side of said central web portion adapted to engage over said guide legs, and mounting means movably mounting said folding element on said support adjacent said discharge end of said guide for movement to engage said W-shaped folding element into said guide and to fold inwardly the end of the strip of material between said guide legs.

2. A device for folding a strip of material, as claimed in claim 1, including a support web mounted adjacent said support alongside the discharge end of said guide, said mounting means comprising a pivot engaged on said web and pivotally supporting said guide.

3. A device for folding a strip of material, as claimed in claim 2, including a first pin mounted on said guide and a second pin mounted on said web and spring means engaged between said pins and urging said folding element in a direction away from said guide, said folding element being pivotable about said pivot to stretch said spring beyond its dead center maximum stretched position, and acting to pull said folding member into engagement with said guide when it moves beyond said maximum stretched position.

4. A device for folding a strip of material, as claimed in claim 1, wherein said support includes a fabric support plate, an additional support plate connected to said fabric support plate, means mounting said additional support plate for pivotal movement along an edge thereof about a substantially horizontal axis and detent means for holding said additional support plate in a horizontal position and being releasable therefrom to permit bending of said support plate downwardly away from said guide.

5. A device for folding a strip of material, as claimed in claim 3, wherein said detent means includes a faceplate alongside the pviotal edge of said additional support plate, a detent arm pivotally mounted on said baseplate engageable with said support plate, said arm being releasable from said support plate to permit the downward movement thereof.

6. A device for folding a strip of material, as claimed in claim 1, including a positioning plate engageable into said guide between said legs to urge the stiffer material therein.

* * * * *

UNITED STATES PATENT AND TRADEMARK OFFICE

CERTIFICATE OF CORRECTION

PATENT NO. : 4,184,439

DATED : January 22, 1980

INVENTOR(S) : Rudi Schulz

It is certified that error appears in the above—identified patent and that said Letters Patent is hereby corrected as shown below:

On the cover sheet Assignee should read:

-- Pfaff Industriemaschinen GmbH --.

Signed and Sealed this

*Fifteenth* Day of *April 1980*

[SEAL]

*Attest:*

SIDNEY A. DIAMOND

*Attesting Officer*

*Commissioner of Patents and Trademarks*